United States Patent [19]

Clearman et al.

[11] 4,420,951

[45] Dec. 20, 1983

[54] FILTER AND DISPENSER SYSTEM FOR AUTOMATIC WASHERS

[75] Inventors: Jack F. Clearman, Blakely, Ga.; James R. Hageman, Pipestone Township, Berrien County; Clark I. Platt, St. Joseph Township, Berrien County, both of Mich.

[73] Assignee: Whirlpool Corporation, Benton Harbor, Mich.

[21] Appl. No.: 391,004

[22] Filed: Jun. 23, 1982

[51] Int. Cl.[3] ..... D06F 39/02

[52] U.S. Cl. ..... 68/17 R; 68/18 F

[58] Field of Search ..... 68/17 R, 17 A, 18 F, 68/18 FA

[56] References Cited

U.S. PATENT DOCUMENTS

| | | | |
|---|---|---|---|
| 598,011 | 1/1898 | Rylander | 68/17 R |
| 2,298,096 | 10/1942 | Dunham | 68/18 F X |
| 2,536,087 | 1/1951 | Powers | 68/18 F |
| 2,554,229 | 5/1951 | Woodson | 68/18 F X |
| 2,792,701 | 5/1957 | Bochan | 68/18 FA X |
| 2,811,033 | 10/1957 | Albrecht | 68/17 R X |
| 2,944,415 | 7/1960 | Smith et al. | 68/18 F |
| 2,971,362 | 2/1961 | Olding | 68/18 F |
| 3,010,304 | 11/1961 | Altorfer | 68/17 A X |
| 3,091,954 | 6/1963 | Bullock et al. | 68/17 A X |
| 3,127,067 | 3/1964 | Hall | 68/17 R X |
| 3,145,552 | 8/1964 | McMillan | 68/17 A |
| 3,145,553 | 8/1964 | McMillan | 68/18 FA |
| 3,248,910 | 5/1966 | Bochan | 68/17 R X |
| 3,805,562 | 4/1974 | Waugh | 68/17 R |
| 3,903,927 | 9/1975 | Gakhar | 68/17 R X |
| 4,043,158 | 8/1977 | Bochan | 68/17 R |

FOREIGN PATENT DOCUMENTS

| | | | |
|---|---|---|---|
| 2710195 | 9/1978 | Fed. Rep. of Germany | 68/17 R |
| 2455113 | 12/1980 | France | 68/17 R |
| 901388 | 7/1962 | United Kingdom | 68/17 R |

*Primary Examiner*—Philip R. Coe

*Attorney, Agent, or Firm*—Hill, Van Santen, Steadman & Simpson

[57] ABSTRACT

A filter and dispenser system for an automatic washer is provided in which a liquid pumping agitator with a top mounted nozzle directs the wash liquid selectively at different locations to perform various functions throughout the washing cycle.

20 Claims, 11 Drawing Figures

FILTER AND DISPENSER SYSTEM FOR AUTOMATIC WASHERS

BACKGROUND OF THE INVENTION

1. Field of the Invention

This invention relates to the use of an automatic washer water pumping agitator in a filter and dispenser system for performing various operations during the course of a washing cycle.

2. The Prior Art

U.S. Pat. No. 598,011 discloses a clothing boiler which pumps water up a center channel to a soap dispenser located closely adjacent to the washer lid with the water then traveling down an outer concentric tube to the wash bath.

U.S. Pat. Nos. 3,010,304; 3,145,552 and 3,145,553 disclose water pumping agitators having dispensers mounted on the top portion of the agitator. In the '304 patent, a centrifically operated valve closure is utilized in the base portion of the dispenser to deflect the water exiting the agitator nozzle into the filter during the wash portion of the cycle. After activation during the spin cycle, the valve allows the rinse additive liquid to pass out of the liquid dispenser and allows the dispenser to be flushed by the water pump through the agitator nozzle. In the '552 patent, a centrifically operated latch mechanism allows the treating agent dispenser to fall into a position to receive liquid exiting the agitator nozzle.

Other patents disclose lid mounted dispensers which receive a liquid from a source for dispensing the agent. Directional nozzles which direct the circulating liquid to different portions of the dispenser to perform the different functions are also known.

SUMMARY OF THE INVENTION

The present invention utilizes a water pumping agitator whose outlet for the wash liquid is directional and selective. Utilizing this concept, the wash liquid can accomplish a plurality of separate functions in the washing machine after the machine's wash cycle has started. A water nozzle at the top of the agitator is designed so that the centrifugal force during spin will cause the nozzle to unlatch from one position and flip to a second position. The nozzle is used in connection with a filter and dispenser located in the automatic washer lid to perform the filtering and dispensing functions during the wash cycle.

DESCRIPTION OF THE PREFERRED EMBODIMENTS

Figure 1:
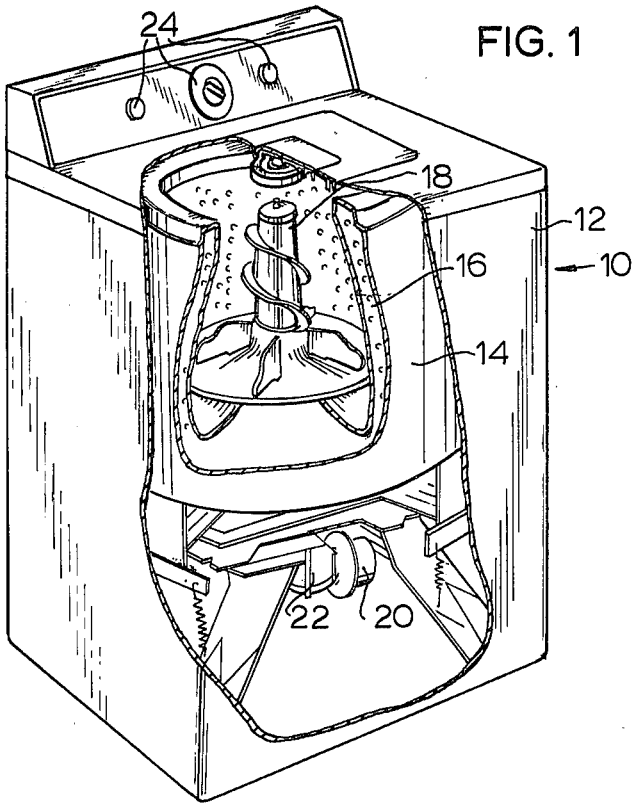
FIG. 1 is a perspective view of a washing machine partially cut away to show the interior mechanism.

In FIG. 1 an automatic washing machine is shown generally at 10 comprising a cabinet or housing 12, an imperforate tub 14, a concentrically mounted perforate basket 16 with a vertical agitator 18, a water supply (not shown), an electrically driven motor 20 operably connected via a transmission 22 to drive the agitator 18 in oscillation, and controls 24 including a presettable sequential control means for use in selectively operating the washing machine through a programmed cycle of operation including a sequence of washing, rinsing and drying steps.

Figure 2:
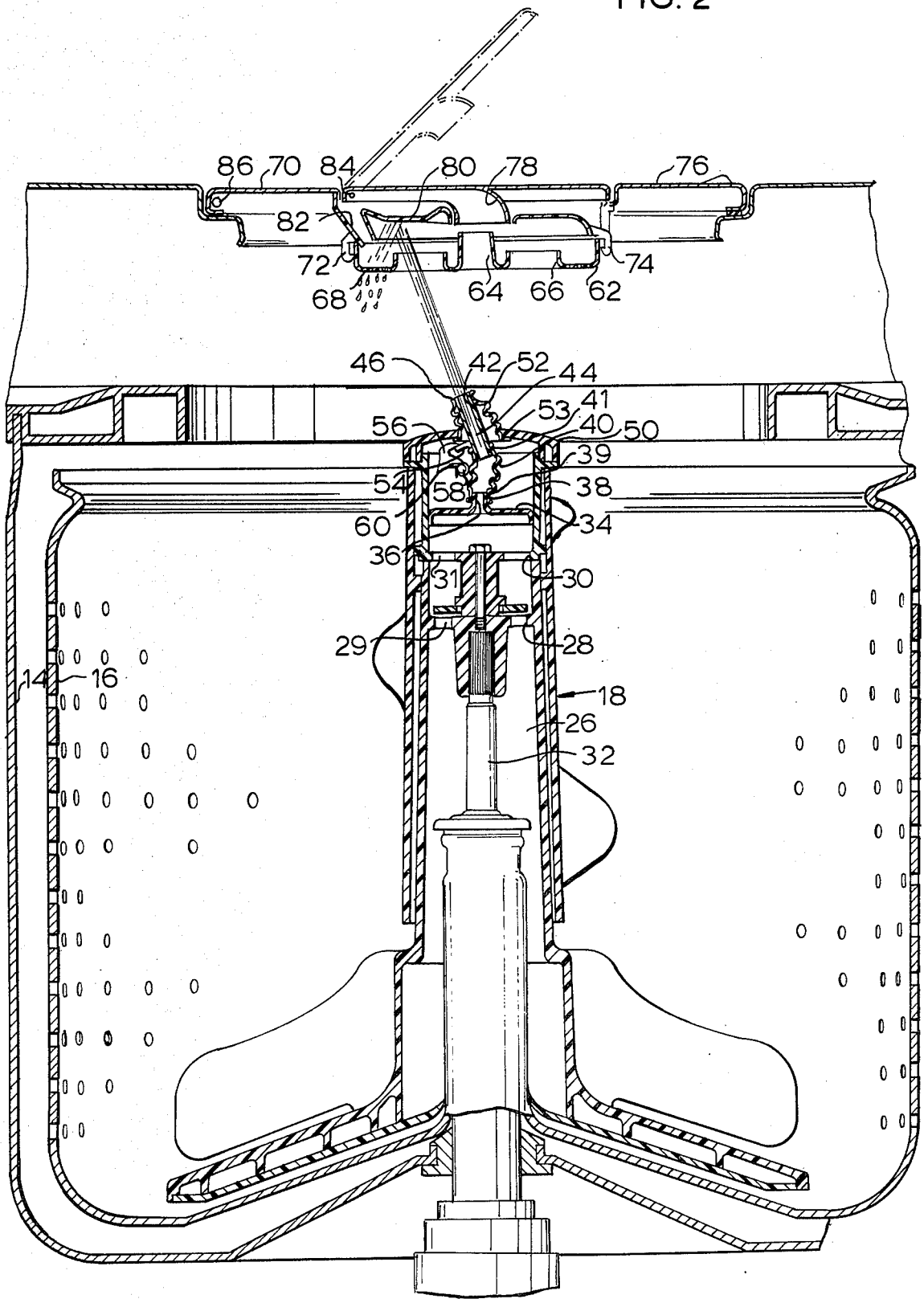
FIG. 2 is a side sectional view of the interior of the tub and basket and showing the interior of the agitator.

FIG. 2 shows a sectional view of the agitator 18 within the tub 14 and basket 16. The agitator 18 can be of a liquid pumping type as disclosed and claimed in U.S. Pat. application Ser. Nos. 294,138, 294,298 and 294,299, all filed Aug. 19, 1981, wherein wash liquid from the basket is pumped upwardly through the interior of the vertical agitator 18 to exit through the top of the agitator. Specifically, a central passage 26 is provided through the interior of the agitator 18 and openings 28, 30 are provided in the structural members 29, 31 which secure the agitator 18 to a drive shaft 32 which drives the agitator.

A shield plate 34 having a central opening 36 is positioned near the top of the agitator 18 and directs the entire flow of wash liquid through the single opening 36. The opening 36 comprises a neck portion 38 to which is secured a bottom end 39 of a flexible sleeve member 40. A top end 41 of the sleeve member 40 is secured to a bottom end of a nozzle 42. The nozzle 42 is pivotally retained in the top of the agitator by means of a pivot pin 44 such that a top end 46 of the nozzle 42 protrudes through an enlarged opening 48 in an agitator cap 50 such that the nozzle 40 is free to pivot within the enlarged opening 48.

A diaphragm member 52 is secured about the top 46 of the nozzle 42 and is attached at a bottom end 53 to the interior of the enlarged opening 48 in the agitator cap. This diaphragm member 52 prevents wash liquid, lint and other objects from entering into the interior of the agitator 18 through the enlarged opening 48.

The nozzle 42 has a finger-like protrusion 54 which can be held by a spring loaded latch 56 to cock the nozzle in a first tilted position as is shown in FIG. 2. The latch 56 is pivoted on a pin 58 and a torsion spring 60 biasses the latch 56 in a clockwise direction in the view shown in FIG. 2.

During the wash cycle as wash liquid is pumped upwardly through the interior passage 26 of the oscillating agitator 18 and out through the nozzle 42 while in the cocked position shown in FIG. 2, the wash liquid stream is directed angularly upwardly toward a lint tray 62. The lint tray 62 is generally circular having a central circular opening 64, a virtually annular opening 66 spaced radially outwardly from the central opening 64 and an annular perforate channel portion 68 forming a filtering means at the outer circumference of the ring. The lint tray 62 is removably secured to a portion of the main lid 70 by latches 72, 74.

Positioned above the lint tray 62 is a secondary lid 76 having a liquid channel 78 therein which directs wash liquid through an additive dispenser tray 80 and toward an opening 82 leading back toward the perforate channel portion 68 of the lint tray 62.

The secondary lid 76 is pivotally mounted on a pair of pins 84 (only one shown) to provide access as shown in phantom to the additive dispenser tray 80. The main lid 70 is pivotally mounted on a pair of pins 86 (only one shown) to provide access to the interior of the basket 16 to charge the basket 16 with a load of clothes to be washed and also to allow removal of the lint tray 62 for cleaning purposes.

When washing a load of clothes, it is sometimes desirable to have a first prewash cycle in which wash liquid is introduced into the basket onto the clothes load and the clothes are subjected to a first agitation period. The purpose of the prewash portion of the washing cycle is to remove the portion of dirt which does not require detergent for its removal. Therefore, the addition of the detergent to the wash load need not take place until the main wash cycle following the prewash. The present invention allows for a first prewash portion of the cycle and a second main wash portion of the cycle in which the detergent is automatically added during the main wash cycle by means of a directionalized stream of wash liquid which is directed away from the detergent during the prewash cycle and toward the detergent during the main wash cycle.

The present invention also allows for any other type of additive to be dispensed onto the clothes load during a second agitation phase of the wash cycle.

As seen in FIG. 2, the nozzle 42 is cocked in a first position at an angle to the vertical by means of the latch 56 catching the finger 54. As the washing machine operates through the prewash cycle, the basket fills with wash liquid and the agitator oscillates to pump wash liquid up through the interior passage 26 of the agitator 18 and out through the nozzle 42. The stream of wash liquid is directed at an angle toward the lint tray 62 and goes upwardly through the annular opening 66 in the lint tray, hits the bottom of the additive dispenser tray 80 and is deflected back into the annular perforate channel 68 which operates as a filter to filter out lint and other particles from the wash liquid. The wash liquid then falls back into the basket 16 and continues in this circulation path throughout the prewash portion of the cycle of operation.

At the end of the prewash cycle, the basket and agitator go into a high speed rotary spin portion of the cycle of operation to remove the wash liquid from the basket 16. During this high speed spin, centrifugal force acting on the latch 56 overcomes the force of torsion spring 60 causing the latch 56 to rotate outwardly about pin 58 releasing finger 54. When this occurs, the sleeve member 40 and diaphragm member 52 cause the nozzle to pivot about pin 44 into a second vertical position.

Figure 3:
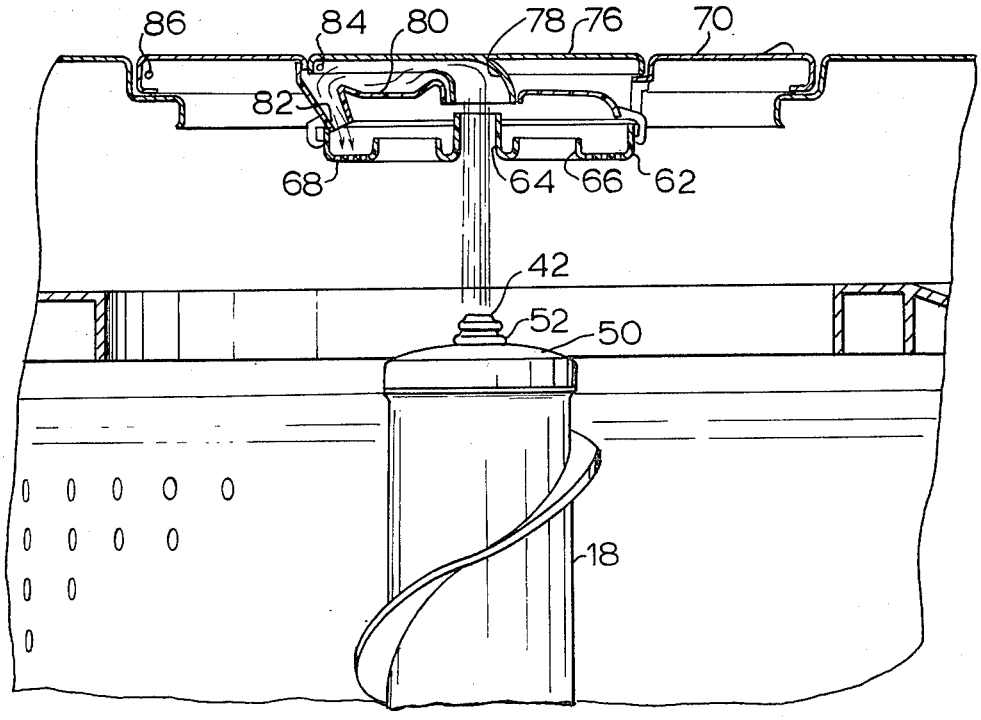
FIG. 3 is a partial sectional view showing a top of the agitator and one embodiment of the dispenser mechanism.

After the initial spin cycle the washing machine proceeds into the main wash portion of the cycle during which time the basket is again filled with wash liquid and the agitator 18 again is driven in an oscillatory movement. In this mode, the agitator again pumps the wash liquid upwardly through the interior of the agitator and up through the nozzle 42 which is now directed vertically upwardly, as is shown in FIG. 3, and causes the stream of wash liquid leaving nozzle 42 to be directed up through the central opening 64 in the lint tray 62 and then through the channel 78 in the secondary lid 76 and through the additive dispenser tray 80 to wash the additive down through opening 82 and through the filtering portion of the filter tray 62 into the basket and clothes load. In this manner, the additive is dispensed onto the clothes load for the main wash portion of the washing cycle. The filtering action of the filter tray is provided during the entire prewash and washing cycles.

Thus, for an operator of the washing machine to automatically wash a load of clothes with a first prewash portion and a second main wash portion of the cycle the operator need only position the nozzle 42 into the cocked position shown in FIG. 2 prior to the beginning of the wash cycle of operation and place an appropriate amount of detergent in the additive dispensing tray 80. The remainder of the washing cycle will take place automatically and there is no need for the operator to return to the machine until the end of the entire washing cycle.

Figure 4:
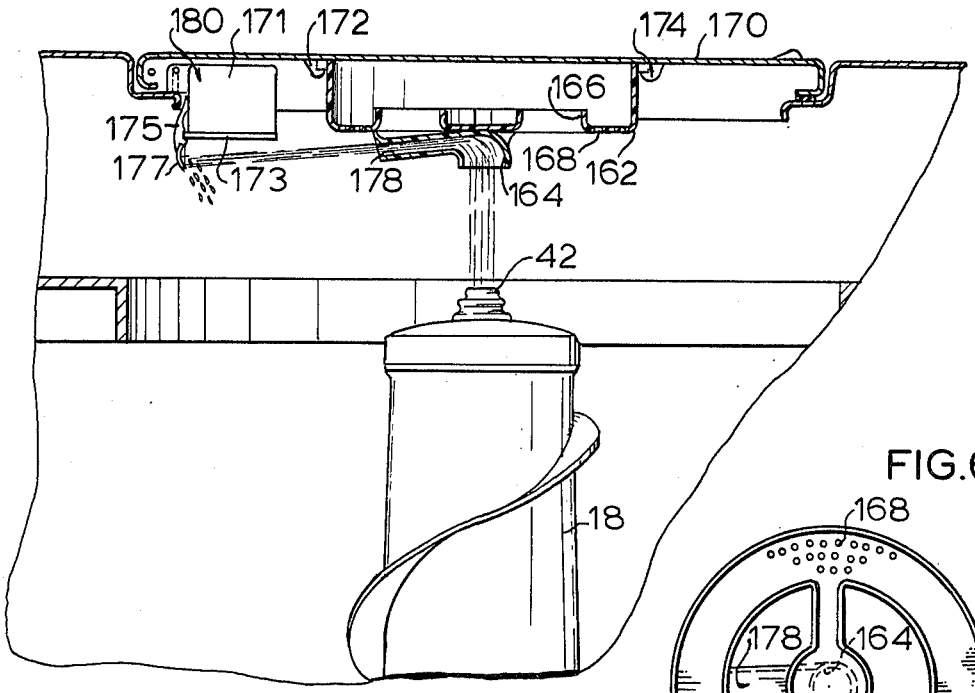
FIG. 4 is a partial sectional view of the top of the agitator and showing a second embodiment of the dispenser mechanism.
Figure 6:
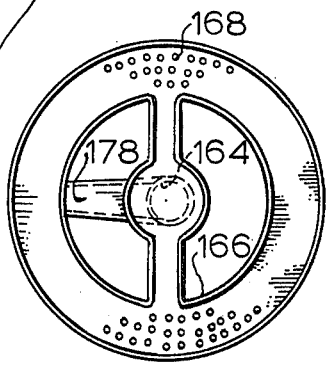
FIG. 6 is a top sectional view of the filter ring taken generally along the lines VI—VI of FIG. 5.
Figure 5:
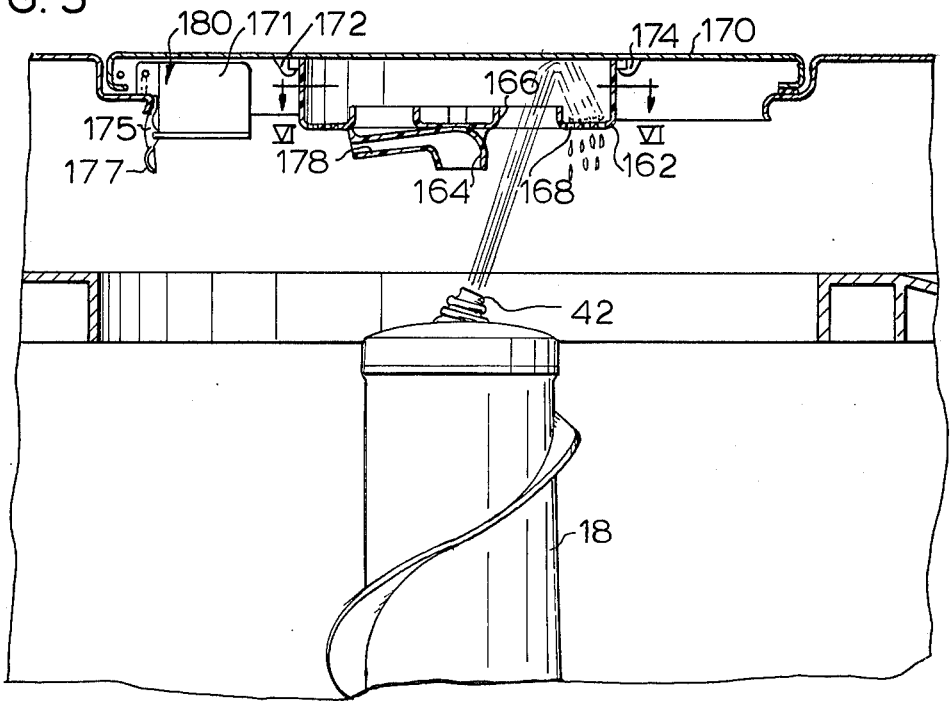
FIG. 5 is a partial sectional view of the top of the agitator and showing the agitator directing the stream of water to a second position in the second embodiment of the dispensing mechanism.

A second embodiment of the present invention is shown in FIGS. 4, 5 and 6 where an identical agitator 18 can be used but which has a slightly different lint tray 162 and additive dispenser 180. The lint tray 162 used in the second embodiment is similar to the lint tray 62 of the first embodiment in that it is essentially circularly shaped, as seen in FIG. 6, and has an essentially annular opening 166 for receiving a stream of wash liquid with the nozzle in the cocked position (FIG. 5), and an annular perforate channel 168 which operates as a filter.

The lint tray 162 is removably secured to a main lid 170 by means of latches 172, 174. However, the lint tray 162 incorporates the central opening 64 and channel 78 of the first embodiment into a nozzle-like member having a central opening 164 and a flow passage channel 178 which is attached to and a part of the lint tray 162 and is positioned on the underside of the lint tray. An additive dispensing mechanism 180 is laterally displaced from the lint tray 162 which is comprised of a box-like member 171 having a hinged wall 173 which can be held in a closed position by means of a pivotable latch 175. The latch member 175 has a cup portion 177 which protrudes below the latched hinged wall 173 which forms the bottom of the box-like member 171.

The operation of the second embodiment is similar to that of the first embodiment in that the operator of the washing machines, if desiring a prewash portion of the cycle, simply cocks the nozzle 42 to the non-vertical position, and introduces a supply of detergent into the additive dispenser 180 and begins the wash cycle of operation. During the prewash portion of the cycle, the pumped stream of wash liquid is ejected from the nozzle 42 up through the annular opening 166 in the lint tray 162, as shown in FIG. 5, and is deflected off the bottom of the lid 170 into the filtering channel 168. When the washing program advances to the spin portion of the cycle, the nozzle moves to the vertical position, as described before, to assume the position shown in FIG. 4. During the main wash portion of the cycle, the pumped liquid stream is directed upwardly into the opening 164 and through the channel 178 to be directed at the cup portion 177 of the latch arm 175. This causes the latch 175 to pivot away from the hinged wall 133 which then drops open and dumps the supply of detergent into the basket.

Thus, the addition of detergent into the basket during the main wash portion of the cycle is done automatically. The lint tray 162 is removable as before for cleaning purposes and the additive dispenser 180 is also removable for filling with detergent or other additive.

Figure 7:
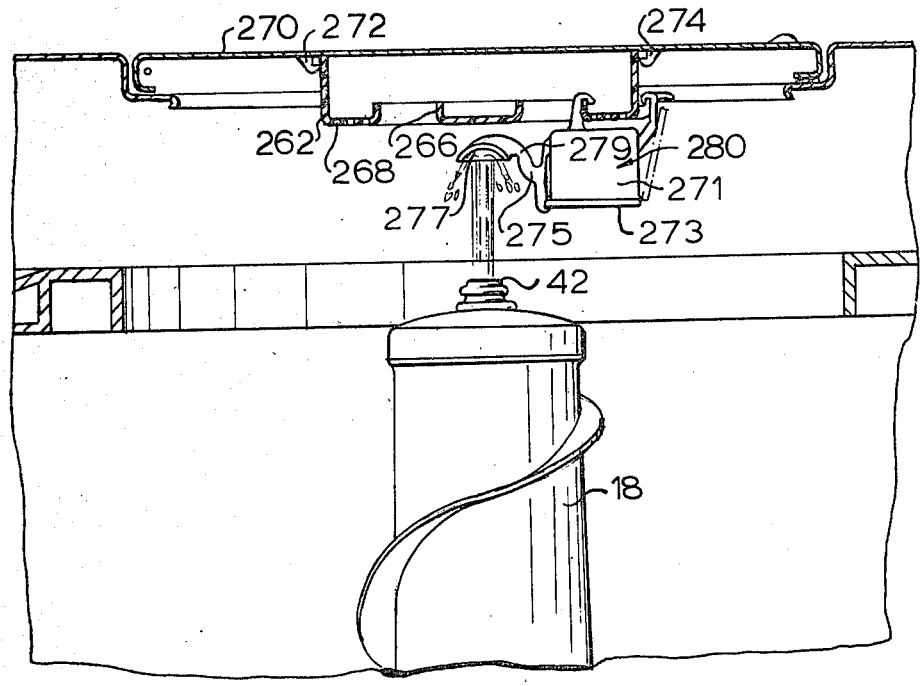
FIG. 7 is a side sectional view of the top of the agitator and a third embodiment of the dispensing mechanism.
Figure 8:
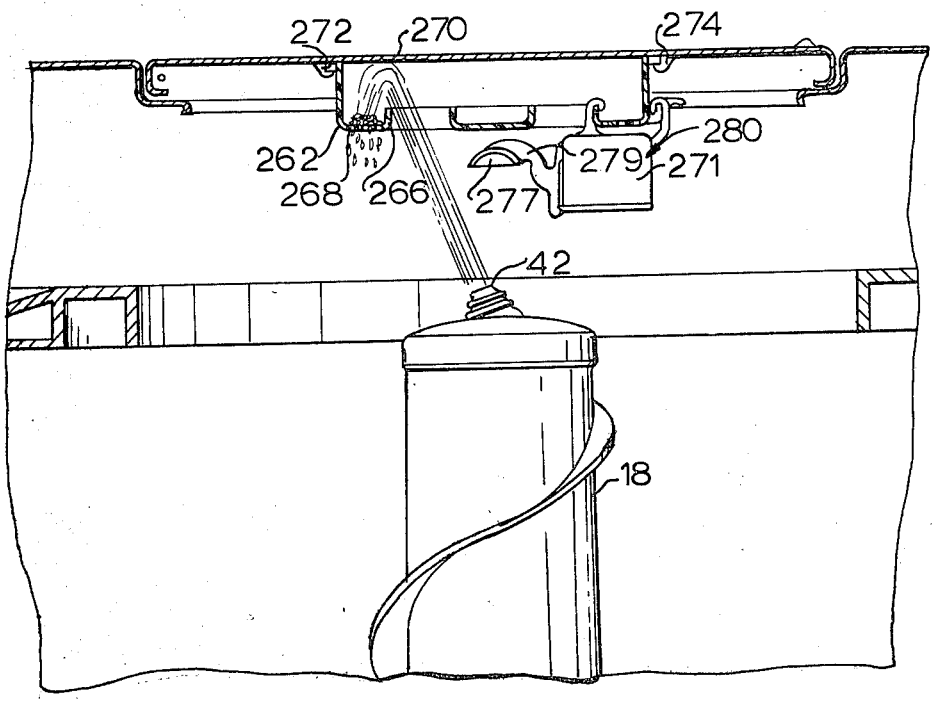
FIG. 8 is a side sectional view of the mechanism shown in FIG. 7 with the agitator directing the stream of water for filtering.

A third embodiment of the additive dispensing and filter system is shown in FIGS. 7 and 8. Again the identical agitator 18 may be utilized which has the nozzle 42 protruding from the top thereof. A modified lint tray 262 is utilized which is very similar to that used in the first embodiment but without the center opening 64. The lint tray 262 has the essentially annular opening 266 and the annular perforate channel 268. The lint tray 262 is removably secured in place by means of latches 272 and 274. An additive dispensing mechanism 280 is removably clipped to the lint tray 262 and is comprised of a box-like additive container 271 having a hinged bottom wall 273 normally biased to an open position **273*a* shown in broken lines in FIG. 7, but which can be held in a closed position by means of a pivotable latch 275. The latch 275 has a cup 277 positioned at the end of an arm 279 which is directly above the nozzle 42 when in the vertical position as shown in FIG. 7**.

The operation of this third embodiment of the detergent dispensing arrangement is similar to that described in the previous two embodiments in that if the operator of the machine desires to operate through a first prewash cycle, the nozzle 42 must be cocked in the non-vertical position and the additive container 271 filled with detergent. During the prewash portion of the washing cycle the stream of wash liquid is directed upwardly through the annular opening 266, deflected off the bottom of the lid 270 and filters down through the perforate channel 268 back into the basket. When the washing program progresses into the spin portion of the cycle between the prewash and main wash portions, the nozzle 42 is again directed upwardly to assume the vertical position shown in FIG. 7. When the program progresses to the main wash portion of the cycle, the pumped wash liquid is directed upwardly and against the cup portion 77 of the latch 75 thereby pivoting it away from the hinged door 273 which opens and dumps the detergent into the basket. Thus, the introduction of detergent into the basket during the main wash portion of the washing cycle is done automatically.

Figure 9:
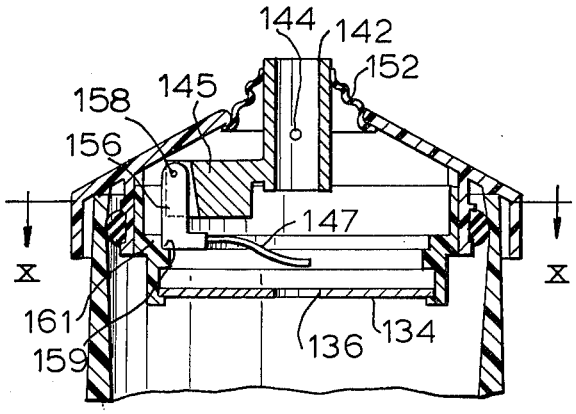
FIG. 9 is a side sectional view of the top of the agitator and showing an alternative embodiment of the nozzle mechanism in the cocked position.
Figure 10:
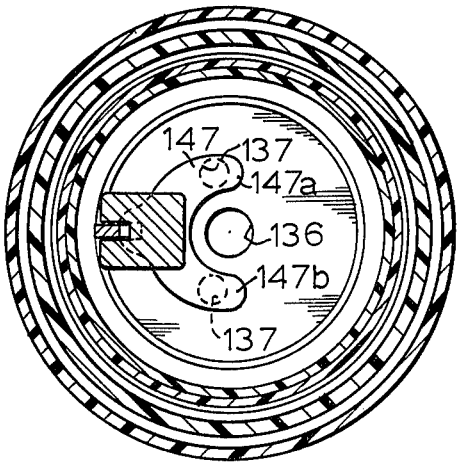
FIG. 10 is a top sectional view of the top of the agitator taken generally along the lines X—X of FIG. 9.
Figure 11:
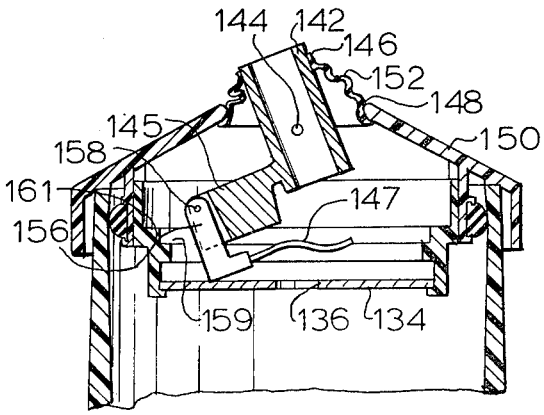
FIG. 11 is a side sectional view of the top of the agitator with the nozzle shown in the tripped position.

FIGS. 9, 10 and 11 show an alternative embodiment of the nozzle arrangement. A control plate 134 has a central opening 136 and two laterally displaced openings 137 therethrough. The control plate 134 is secured in a ring member 161 below the nozzle 142 such that the central opening 136 aligns with the passage through the nozzle. The nozzle 142 is pivotally mounted by means of pin 144 and has an off-balance weight 145 formed near a lower end thereof and below the pivot pin 144. A latch member 156 is pivotally attached to the off-balance weight 145 by means of a pin 158. A latch sensor arm 147 having a C-shape is secured to the non-pivoted end of the latch member 156 such that the two ends **147*a* and 147*b* of the arm 147 are in vertical alignment with the laterally displaced openings 137 in the control plate 134**.

During the spin portion of a washing cycle, centrifugal force acts on the off-balance weight 145 causing it to move outwardly and thereby causing the nozzle 142 to pivot about pin 144. As the off-balance weight 145 moves outwardly, the latch member 156 climbs up on a ledge 159 of ring member 161, as shown in FIG. 9, which automatically cocks the nozzle 142 into the vertical position. When the washing program advances to an agitation or wash portion of the cycle, the pumped wash liquid is directed upwardly through the center of the agitator 18 and through openings 136 and 137. The liquid passing through opening 136 passes between the ends of the arm 147 and proceeds up through the nozzle 142. The wash liquid passing through openings 137 contacts the latch sensor arm 147 which causes the latch member 156 to trip off of the ledge 159. The off-balance weight 145 causes the nozzle to pivot about pin 144 and to assume the non-vertical position shown in FIG. 11. The remainder of the wash cycle is carried out with the nozzle in the non-vertical position. A diaphragm 152 is connected between an enlarged opening 148 and a top end 146 of the nozzle 142 to prevent wash liquid from escaping from the agitator cap 150 during the movement of the nozzle 142 in its functions and to prevent wash liquid, lint and other objects from entering the interior of the agitator 18.

The nozzle 142 maintains the non-vertical position until the spin portion of the washing cycle is repeated at which time the nozzle is automatically returned to the vertical position in the manner described above.

When the agitation or wash portion of the cycle begins, enough liquid is pumped vertically upwardly prior to the latch member 156 tripping off of ledge 159 to perform the unlatching of latch 175 in the second embodiment or latch 275 in the third embodiment.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. In an automatic washer having a cabinet housing a basket for containing clothes to be washed, a lid for said cabinet providing access to said basket, an agitator within the basket, said agitator having a top portion projecting upwardly in said basket, a motor and transmission connected to drive said agitator, a sequential control for controlling said washer through a cycle of operation, and an additive dispenser system for said automatic washer, said additive dispenser system comprising:

means for pumping liquid to said top portion of said agitator;

nozzle means mounted on said agitator top portion for directing said liquid, said nozzle having a first position and a second position;

filtering means mounted in said lid above said agitator top portion, said filtering means having receptacle means for receiving liquid from said nozzle in said first position;

additive dispensing means mounted above said agitator top portion, said dispensing means having receiving means for receiving liquid from said nozzle in said second position; and control means operable to move said nozzle from said first position to said second position.

2. The automatic washer of claim 1, wherein said control means includes centrifugal means operable under the application of centrifugal force created during a spin drying portion of said cycle for allowing said nozzle to move from said first position to said second position.

3. In an automatic washer having a cabinet housing a basket for containing clothes to be washed, a vertically disposed motor driven agitator within said basket, an additive dispenser system for said automatic washer comprising:

means for pumping liquid up through said agitator;

nozzle means pivotally mounted in the top of said agitator and communicating with said pumped liquid, said nozzle movable between a first position and a second position;

filtering means positioned to receive liquid from said nozzle in said first position;

additive dispensing means positioned to receive liquid from said nozzle in said second position; and control means operable to move said nozzle from said first position to said second position.

4. The automatic washer of claim 3, wherein said control means includes means operable under the application of centrifugal force resulting from said basket spinning during a wash cycle.

5. The automatic washer of claim 4, wherein said control means includes a spring loaded pivotable latch which captures a protrusion on said nozzle to retain it in said first position until the application of centrifugal force from said basket spinning causes the latch to pivot outwardly releasing said protrusion and resilient means attached to said nozzle operate to move said nozzle to said second position.

6. The automatic washer of claim 3, wherein said filtering means is a horizontal filter ring mounted under a lid of said washer.

7. The automatic washer of claim 6, wherein said filter ring is selectively removable.

8. The automatic washer of claim 3, wherein said additive dispensing means includes an additive container and a channel to redirect said liquid from said nozzle toward said additive container to cause the dispensing of said additive from said container.

9. The automatic washer of claim 8, wherein said container is a tray located in said channel.

10. The automatic washer of claim 9, wherein said channel directs said liquid toward said filtering means.

11. The automatic washer of claim 9, wherein said channel and tray are mounted on a main lid of said washer cabinet and a secondary lid in said main lid provides access to said tray for the charging of an additive.

12. The automatic washer of claim 8, wherein said container has a hinged door openable by means of said directed wash liquid.

13. The automatic washer of claim 12, wherein said hinged door is openable by means of said directed liquid pushing against a pivotable latch.

14. The automatic washer of claim 12, wherein said container is laterally displaced from said filter.

15. The automatic washer of claim 12, wherein said container is secured to said filter.

16. The automatic washer of claim 3, wherein said additive dispensing means is selectively removable for charging with an additive.

17. The automatic washer of claim 3, wherein said filtering means is selectively removable for cleaning.

18. In an automatic washer having a cabinet housing a basket for containing clothes to be washed, a vertically disposed motor driven agitator within said basket, an additive dispenser system for said automatic washer comprising:

means for pumping liquid up through said agitator;

nozzle means pivotally mounted in the top of said agitator and communicating with said pumped liquid, said nozzle movable between a first position and a second position;

filtering means mounted above said agitator positioned to receive liquid from said nozzle in said first position;

additive dispensing means positioned to receive liquid from said nozzle in said second position; and control means operable to move said nozzle from said first position to said second position and said second position to said first position.

19. The automatic washer of claim 18, wherein said control means includes means operable under the application of pumped liquid to move said nozzle from said second position to said first position and means operable under the application of centrifugal force to move said nozzle from said first position to said second position.

20. The automatic washer of claim 19, wherein said pivotable nozzle has an off-balance weight depending therefrom with a latch which, upon the application of centrifugal force, causes said latch to lock said nozzle in said second position;

said latch having an arm, which when struck by pumped liquid, unlocks said nozzle, said unlocked nozzle then pivoting to said first position due to said off-balance weight.

* * * * *